US007846076B2

(12) United States Patent
Salzwimmer et al.

(10) Patent No.: US 7,846,076 B2
(45) Date of Patent: Dec. 7, 2010

(54) TRAINING APPARATUS

(75) Inventors: Johann Salzwimmer, Grossraming (AT); Bruno Bernreiter, Waidhofen/Ybbs (AT); Karl Wilhelm Enzlberger, Steyr (AT)

(73) Assignee: Smovey GmbH, Steyr (AT)

( * ) Notice: Subject to any disclaimer, the term of this patent is extended or adjusted under 35 U.S.C. 154(b) by 0 days.

(21) Appl. No.: 12/310,669

(22) PCT Filed: Jun. 6, 2007

(86) PCT No.: PCT/AT2007/000274

§ 371 (c)(1),
(2), (4) Date: Apr. 13, 2009

(87) PCT Pub. No.: WO2007/140502

PCT Pub. Date: Dec. 13, 2007

(65) Prior Publication Data

US 2009/0280967 A1 Nov. 12, 2009

(30) Foreign Application Priority Data

Jun. 6, 2006 (AT) ..... A 968/2006

(51) Int. Cl.
*A63B 21/22* (2006.01)

(52) U.S. Cl. ..... 482/110; 482/92; 482/44

(58) Field of Classification Search ..... 482/44–50, 482/92, 110, 148

See application file for complete search history.

(56) References Cited

U.S. PATENT DOCUMENTS

| | | | | |
|---|---|---|---|---|
| 4,215,510 | A * | 8/1980 | Worrell | 446/28 |
| 5,692,944 | A * | 12/1997 | Pellicone | 446/170 |
| 6,099,444 | A | 8/2000 | Domenge | |
| 6,500,102 | B1 * | 12/2002 | Domenge | 482/110 |
| 2002/0177507 | A1 | 11/2002 | Carbone | |

FOREIGN PATENT DOCUMENTS

| | | |
|---|---|---|
| GB | 855312 | 11/1960 |
| JP | 2005278840 | 10/2005 |

* cited by examiner

*Primary Examiner*—Glenn Richman
(74) *Attorney, Agent, or Firm*—Lucas & Mercanti, LLP; Klaus P. Stoffel

(57) ABSTRACT

The invention relates to a training apparatus, in particular for the muscle system of the hand, arm and upper body, wherein the apparatus has an elongate casing with at least an essentially circular internal cross section, in the interior of which at least one ball (5) is situated in a freely movable manner between shock absorbers (6). There are various forms of such training apparatuses. Their disadvantages include relatively monotonous training and the difficulty or impossibility of using them to train during another activity, for example during running. In order to avoid this, the invention is characterized in that the casing is of flexible design over at least part of its longitudinal extent, in that the ends of the casing are fastened to a handle part, and in that handle part and casing lie at least essentially on one plane.

8 Claims, 2 Drawing Sheets

TRAINING APPARATUS

The invention concerns an exercise apparatus, especially for exercising the muscles of the arms and upper body. The exercise apparatus of the invention has an elongated casing with an inner cross section that is at least essentially circular. The interior of the casing contains at least one ball that can move freely between shock absorbers.

Exercise devices of this type are disclosed by U.S. Pat. No. 6,099,444 A and JP 2005278840 A. The first document discloses several exercise devices with moving balls or oval bodies arranged inside races of various designs and closed cross section. In this regard, we can distinguish basically between races that are closed upon themselves (oval, figure-of-eight, etc.) and linear races. Only the latter have shock absorbers at their ends to prevent the transmission of harmful shocks to the joints of the subject. The exercise devices with closed races have, if at all, only gripping parts that project from the plane of the race. The same applies to the Japanese patent application cited above, which has a semicircular grip set on the circular race with a closed cross section.

Another exercising apparatus is disclosed by GB 855,312 A. A tube can be moved linearly between shock absorbers inside a tube with a closed cross section that serves as a guide and gripping part.

DE 71 41 232 U describes a toy for playing a game, in which a ball is moved in a circular track with a cross section that is open towards the inside, where a gripping part is mounted on the outside in the plane of the track. This device is hardly suitable for exercise purposes.

Other training apparatuses are available in the form of dumbbells, expanders, and the like. One disadvantage of these devices is that exercising with them is usually relatively monotonous. Another is the difficulty or impossibility of performing this exercise during another activity, for example, while running. Aside from the gripping parts, all of these devices also consist at least predominantly of hard material, which makes their use in combination with another activity, such as running, at least difficult.

The objective of the invention is to create an exercise apparatus that does not have these disadvantages and can be used in a variety of ways, where, in at least one embodiment, the nerves of the subject are specially stimulated.

In accordance with the invention, the principal objective is achieved by virtue of the fact that the casing has a flexible construction over at least a portion of its longitudinal extent, that the ends of the casing are attached to a gripping part, and that the casing and the gripping part lie at least essentially in a plane.

In this way, an essentially oval exercise apparatus is obtained, in which, for example, the closed casing consists of a spiral tube, in which several steel balls were placed before the ends of the spiral tube were pushed over a piece of tubing, which in turn was drawn over a rigid tube, whereby the spiral tube was given an approximately oval shape. A handle, i.e., a type of grip made of a suitable material, for example, foam rubber, is preferably attached in the area of the rigid tube.

As a result of this design, the exercise apparatus has no sharp edges and no hard areas on the outside and therefore can be safely used even during hiking, jogging, and other activities in which the muscles of the upper body and especially of the arms and hands are not usually exercised.

However, the flexibility of the tubing and the mobility of the steel balls also result in continuous changes in how the grip feels in the hand of the user, which causes a reaction of the muscles involved in holding the exercise apparatus, so that fine-motor skills and reflexes are also developed. If a spiral tube is used, i.e., any type of tube that is provided with spiral (actually, helical) reinforcement, then the balls moved in the spiral tube are caused to vibrate and rotate by these helical elevations of the inside surface of the spiral tube, and these vibrations and rotations of the balls specially stimulate the nerves of the user's palms and specially activate the associated muscles.

The rigid tube can consist of copper, steel, aluminum, or their alloys, and the piece of tubing extends beyond both ends of the rigid tube. This ensures that the spiral tube does not kink at the end of the rigid tube but rather is elastically supported by the piece of flexible tubing. The tubing can be an ordinary garden hose or tubing with similar mechanical properties. Naturally, it is also possible to produce a special, one-piece part, onto which the spiral tube is pushed. In this regard, it is also possible for this part to be provided with shock-absorbing or elastic ends.

Mechanically shock-absorbing or elastic elements are placed in the spiral tube at both ends of the piece of tubing, so that when a ball hits the end of the spiral tube, the shock is absorbed and stress on the joints of the user is reduced. The simplest type of shock absorber is a plug of foam rubber. It is also possible to use helical springs, sponge rubber, and other elastically deformable elements. These shock-absorbing elements can be dispensed with if the end of the tubing itself is designed to be shock-absorbing or elastic.

The invention is described in greater detail below with reference to the drawings.

Figures 1, 2:
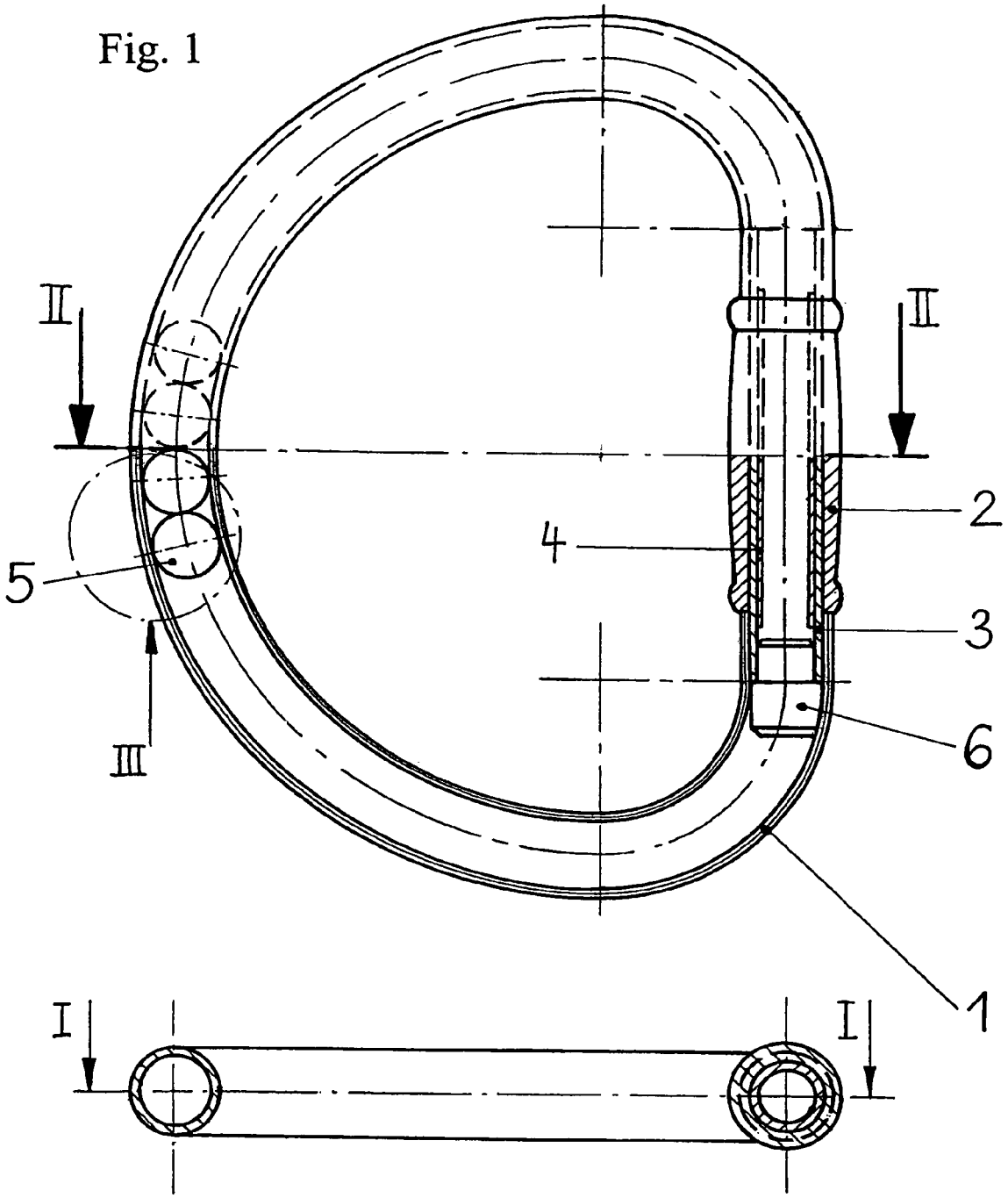
FIG. 1 shows a schematic cross section along line I-I of FIG. 2.
FIG. 2 shows a schematic cross section along line II-II of FIG. 1.

As is apparent from the drawings, which are schematic representations of an embodiment of the invention, this device consists essentially of a flexible spiral tube 1 of the type that is used, for example, as a suction tube in water pumps, preferably with a diameter of 20-30 mm. Both ends of this spiral tube 1 are drawn over a piece of short, flexible tubing 3 of matching outside diameter, in the central region of which a grip was previously mounted. In the illustrated embodiment, the end faces of the spiral tube 1 abut the end faces of the grip 2, which produces a uniform and visually attractive exterior.

A rigid tube 4, for example, a copper tube with a diameter of 18 mm, is located inside the piece of flexible tubing 3. The piece of flexible tubing 3 is somewhat longer than the rigid tube 4 and thus extends beyond it at both ends. This rigid tube 4 provides the device with strength and stability in the area of the grip 2 without producing any risk of injury. A shock absorber 6, for example, a plug of foam rubber, is inserted at both ends of the piece of flexible tubing 3 to absorb shock or prevent the transmission of shock when a ball 5 hits the end of the tubing 3. Naturally, a different type of damping or resiliency can be provided, e.g., by a helical spring or the like. If the gripping part is constructed as one piece, then its ends to be slipped over the spiral tube 1 are preferably designed to be elastic. The essential requirement is that no shocks from the balls striking the end be transmitted directly to the hand. The shock absorbers can be rigidly joined with the flexible tubing 3, for example, by adhesive bonding.

Figure 3:
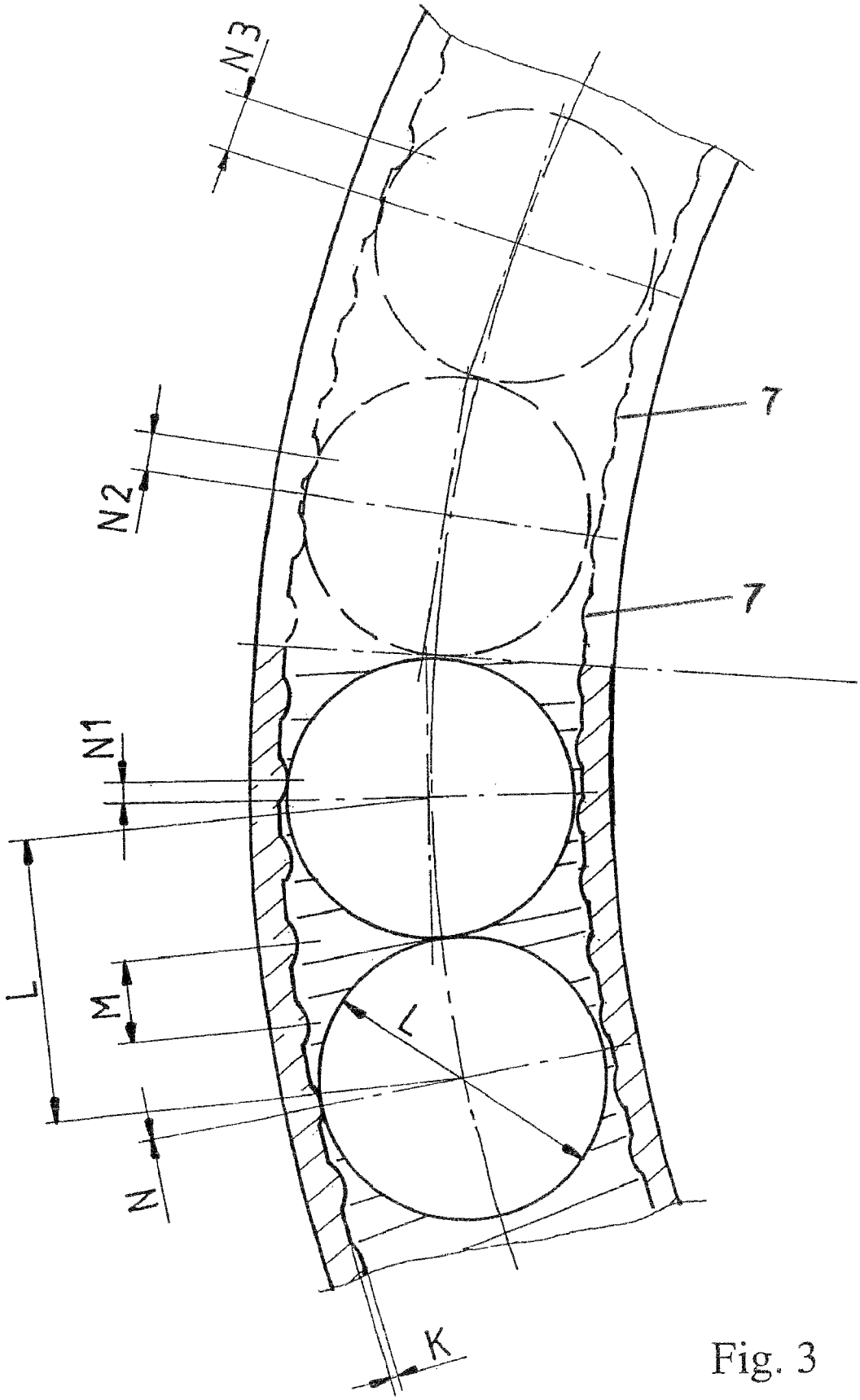
FIG. 3 is a detail drawing corresponding to arrow III of FIG. 1.

As FIG. 3 shows especially well, steel balls 5 (in the illustrated embodiment, four steel balls 5) are installed in the spiral tube 1. The outside diameter L of the steel balls 5 is somewhat smaller than the inside diameter of the spiral tube, so that the balls 5 can move even in the curved region of the spiral tube and can be displaced in the spiral tube 5, depending on the movement of the user. In this regard, they roll/slide over the helically running spirals 7, which project inwardly into the tube 1 and extend above the "smooth part" of the tube by the amount K (ridge height) at a separation M (ridge width). The resulting shaking motion causes vibration of the apparatus and thus of the grip 2, which specially excites the nerves of the subject and thus helps to build his muscles.

In the example shown here, M and L are chosen in such a way that, when the balls are in contact with one another, as shown in FIG. 3, their points of contact with the outer inside surface of the spiral tube are located in different places relative to the spiral ridges, i.e., the ball diameter L is not an integral multiple of the ridge width M, neglecting deformations caused by the curvature of the spiral tube. This is indicated by the different dimensions N, N1, N2 and N3. As a result, when the balls are in motion, "shaking" occurs at different times, which increases (in the illustrated case, quadruples) the overall shaking frequency, which has a strongly positive effect on the nerves of the subject.

During exercise, the rigid tube 4 along with the flexible tubing 3 and the easy deformability of the spiral tube 1 also produce continuous change in the shape of the spiral tube outside the area of the rigid tube 4 as a function of the given movement and the given position and speed of the steel balls.

FIG. 2 reveals the slender and compact construction of the device, which simplifies its transport and storage.

The invention can be modified in a variety of ways. It is possible, for example, to vary the diameter and length of the spiral tube to adapt them to the fitness and ambitions of the user. Naturally, instead of the combination of a copper tube and an intermediate piece of flexible tubing, it is possible to use a one-piece plastic part, which preferably then also forms the grip as a single part. Instead of steel balls, it is possible to use balls made of a different material. If, for example, it would be desirable to move smaller weights, aluminum balls could be used. On the other hand, for special purposes the use of balls made of lead or the like or the use of lead-filled balls would be conceivable. The rigid tube does necessarily have a linear design but rather can be bent, kinked, or crimped. These and many other embodiments and modifications are possible.

If a definite design and intended purpose of the device have been established, the device can be permanently sealed in the area of the rigid tube 4, especially by adhesive bonding. However, to allow a variety of exercise situations easily to be taken into account, the device can simply be pushed onto the rigid tube and possibly held there with a pinching device. Fixing devices of this type are known from sprinkling system hoses and therefore require no further explanation here.

Devices that are especially preferred have a spiral tube with a length of 60-80 cm and a diameter of about 24 mm, four steel balls with a diameter of 22 mm, a copper tube with a length of 20-30 cm and a diameter of 18 mm, and a piece of flexible tubing with a diameter of 20 mm and a length of 20-32 cm, but with the condition that it must be longer than the copper tube. A commercial foam rubber grip is used as the handle. Naturally, the invention is not limited to this specific embodiment or the specific embodiment illustrated in the drawings, but rather can be modified in a variety of ways, as was mentioned in the preceding description.

It is essential that the balls be able to move over at least a considerable part of the length of the casing that contains them, that the casing is flexible over a considerable part of its length, and that the ends of the casing are mounted in a grip of some type.

If the grip has a linear design, then the path axis develops the form of a flattened oval with a radius of curvature that varies over the course of the path, and this results in very favorable excitation of the nerves of the exercising person.

The invention claimed is:

1. An exercise apparatus, especially for exercising the muscles of the hands, arms, and upper body, with an elongated casing with an inner cross section that is at least essentially circular, where the interior of the casing contains at least one ball (5) that can move freely between shock absorbers (6), wherein the casing has a flexible construction over at least a portion of its longitudinal extent, where the ends of the casing are attached to a gripping part, and where the casing and the gripping part lie at least essentially in a plane, wherein the gripping part is pushed over a piece of flexible tubing (3), which in turn is pulled over a rigid tube (4), where the ends of the casing are pushed over the flexible tubing (3) until they reach the grip (2).

2. An exercise apparatus in accordance with claim 1, wherein the casing consists of a plastic spiral tube (1).

3. An exercise apparatus in accordance with claim 1, wherein the gripping part consists of a grip (2) that is at least essentially linear.

4. An exercise apparatus in accordance with claim 3, wherein the shock absorbers (6) are arranged near the ends of the flexible tubing (3).

5. An exercise apparatus in accordance with claim 1, wherein the balls (5) are made of steel.

6. An exercise apparatus in accordance with claim 1, wherein the rigid tube (4) is made of steel, aluminum, copper, or their alloys.

7. An exercise apparatus in accordance with claim 2, wherein the balls (5) have a diameter (L) which, when divided by the distance (M) from spiral ridge to spiral ridge of the spiral tube (4), does not yield a quotient that is a whole number.

8. An exercise apparatus in accordance with claim 1, wherein the spiral tube (1) has a length of 40-100 cm, preferably 60-80 cm, and a diameter of about 22 mm, where the rigid tube (4) is a copper tube with a diameter of about 18 mm and a length of 20-30 cm, where the flexible tubing (3) has a diameter of about 20 mm and a length of 20-33 cm but with the condition that it extends beyond both ends of the rigid tube (4), where a shock absorber (6) is inserted in both ends of the piece of flexible tubing (3), and where four to seven steel balls (5) with a diameter of about 22 mm are provided in the spiral tube (1).

* * * * *